United States Patent [19]

Burt

[11] Patent Number: 4,713,999

[45] Date of Patent: Dec. 22, 1987

[54] DUAL HARMONICA ARRAYS AND HARMONICA RECEPTACLES

[76] Inventor: Raymond J. Burt, 30 3rd St., Waterford, N.Y. 12188

[21] Appl. No.: 870,798

[22] Filed: Jun. 5, 1986

[51] Int. Cl.[4] ..... G10G 5/00
[52] U.S. Cl. ..... 84/379
[58] Field of Search ..... 84/379

[56] References Cited

U.S. PATENT DOCUMENTS 303,743 8/1884 Murphy ..... 84/379
1,884,150 10/1932 Numberg ..... 84/379
1,954,169 4/1934 Futer ..... 84/379

FOREIGN PATENT DOCUMENTS 31762 6/885 Germany ..... 84/379

*Primary Examiner*—Lawrence R. Franklin
*Attorney, Agent, or Firm*—William A. Teoli

[57] ABSTRACT

Dual harmonica arrays and dual harmonica receptacles are provided, facilitating the playing of dual diatonic, chord and bass harmonicas. The harmonicas are maintained in a lower forward position and an upper rear position which are readily reversible.

19 Claims, 11 Drawing Figures

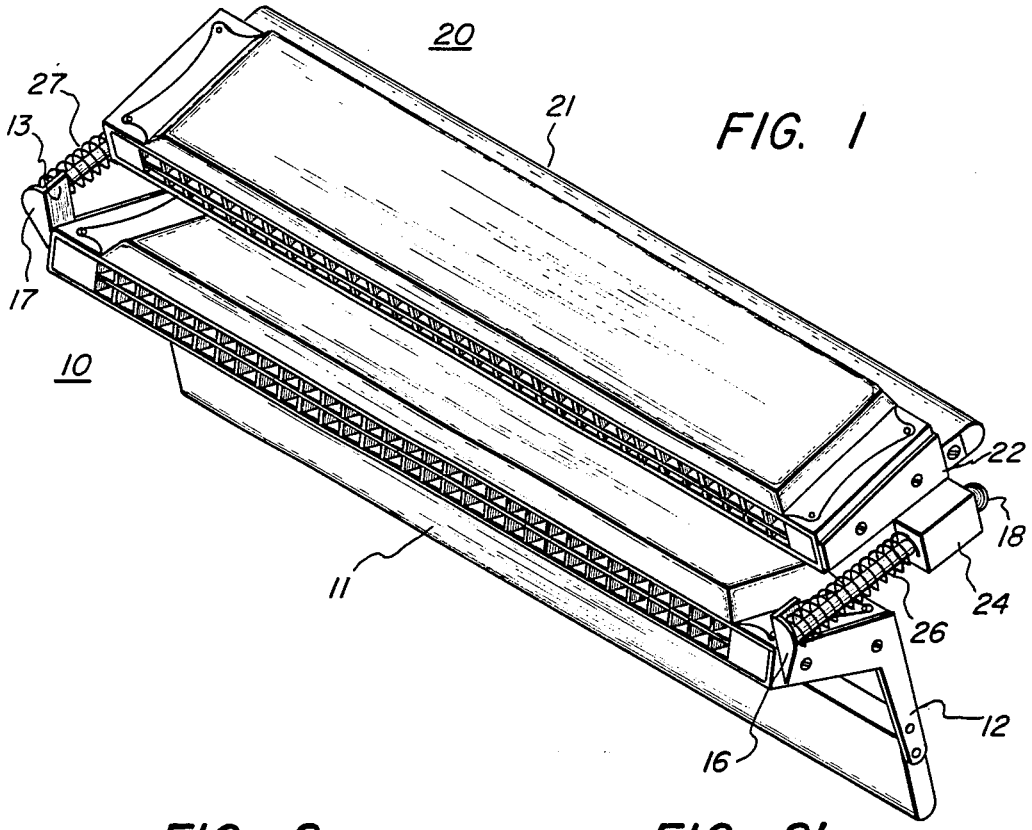
FIG. 1
FIG. 2a
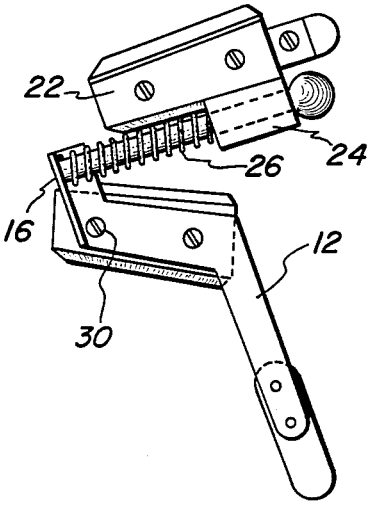
FIG. 2b
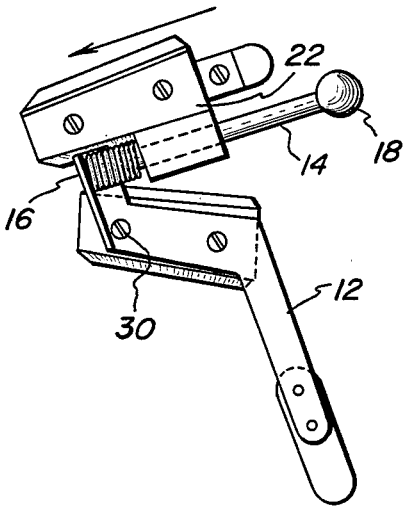

DUAL HARMONICA ARRAYS AND HARMONICA RECEPTACLES

BACKGROUND OF THE INVENTION

The present invention relates to dual harmonica arrays and to dual harmonica receptacles. More particularly, the present invention relates to a particular dual harmonica arrangement whereby the holding of a harmonica combination and the separate playing of the component harmonicas is significantly facilitated.

Prior to the present invention, harmonica sets, such as the octave tuned bass having a lower natural tone section and an upper sharp and flat section, were joined by terminal U shaped foldable brackets. The two foot chord harmonica having an upper major chord section and a lower minor chord section also is held together by terminal foldable U shaped brackets permitting an inward and outward bending action from a common axis allowing a nominal degree of harmonica separation.

The aforementioned dual harmonica arrays with terminal brackets generally allows the player to hold the instrument while playing to a slow or regular beat. However, it is often difficult to achieve true separation of the harmonicas while playing the dual array to a fast or irregular beat. Recently, harmonica packs have become popular allowing the player to simulate playing a chromatic harmonica without a slide, by separately playing each harmonica using manual rotation to achieve a combination effect. However, it has been found that manual rotation of diatonic harmonicas also can be awkward.

The object of the present invention therefore is to provide various dual harmonica arrays allowing the positioning of the harmonicas in an uneven or asymmetric manner to facilitate the separate playing of the two harmonicas.

A second object of the present invention is to provide dual harmonica arrays having a handle attached to at least one of the two harmonicas to facilitate the control or holding of the harmonicas.

A third object of the present invention is to provide dual harmonica arrays where the two harmonicas are joined by terminal brackets allowing the harmonica to be randomly maintained in an asymmetric relationship.

Another object of the present invention is to provide dual harmonica arrays allowing the playing of one of the harmonicas without interference from the other harmonica.

A further object of the present invention is to provide dual harmonica arrays consisting of a lower forward and an upper rear harmonica and ready access to either harmonica during the playing of the harmonicas.

An additional object of the present invention is to provide a dual harmonica array having an upper rear harmonica and a lower front harmonica, a handle attached to the front harmonica to facilitate the holding of the harmonica array, and a handle section attached to the upper rear harmonica to facilitate sliding the upper rear harmonica past the lower harmonica to facilitate its separate playing.

A further object of the present invention is to provide dual harmonica receptacles to maintain two harmonicas in a substantially parallel asymmetric relationship comprising terminal holders for upper and lower harmonicas, handles, and a means for laterally switching the upper and lower harmonicas to reverse their respective asymmetric position.

These and other objectives of the present invention will become apparent from the foregoing description.

STATEMENT OF THE INVENTION

There is provided by the present invention, harmonica arrays comprising two harmonicas, means for maintaining the two harmonicas in a spaced, substantially parallel asymmetric relationship, and means for rapidly reversing the asymmetric relationshsip of the two harmonicas while maintaining their spaced substantially parallel attitude.

In another aspect of the present invention, there is provided dual harmonica receptacles comprising a first and second holder for harmonicas, means for joining the two harmonica holders to maintain them in a substantially parallel asymmetric relationship, and means for rapidly reversing the asymmetric relationship of the two harmonica holders while maintaining them in a substantially parallel orientation.

In a third aspect of the invention, there are provided plural element terminal brackets comprising a first and a second face plate, the first face plate having a stud element forming an acute angle thereon, the second face plate having a sleeve element which can slide along the stud element of the first face plate, and means for regulating the sliding of the sleeve element of the second face plate along the stud element of the first face plate.

DETAILED DESCRIPTION OF THE INVENTION

In order that those skilled in the art will be better able to understand the dual harmonica arrays of the present invention, reference is made to the drawings.

FIG. 1 is an isometric view of a dual array of diatonic harmonicas having handles and terminal brackets.

FIGS. 2*a* and 2*b* are schematic views of the terminal brackets of FIG. 1, and the switching action provided by the terminal brackets to reverse the position of the upper rear and lower front harmonicas.

Figure 3:
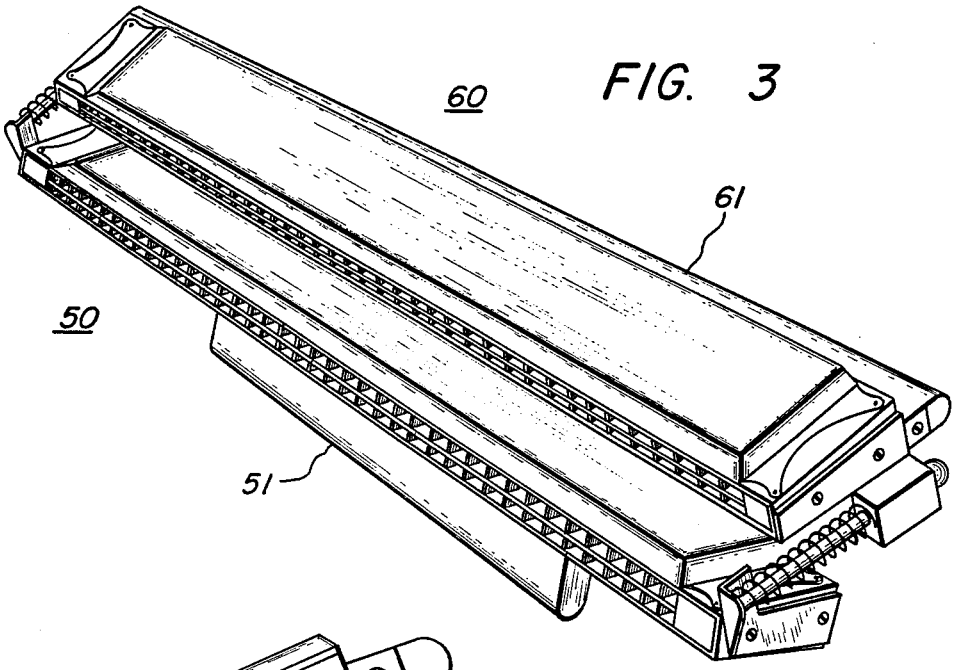
FIG. 3 is a view in perspective of a chord harmonica showing terminal brackets, a centrally located handle for the lower front harmonica, and an attached rear handle substantially equal to the length of the upper rear harmonica.

There is shown more particularly in FIG. 1 at 10 and 20, diatonic harmonicas having an average length of 6 to 10 inches. Handle sections, which can be wood, injection moldable high performance thermoplastic, such as Lexan polycarbonate, Lucite resin, Noryl resin, or metal such as aluminum, are shown respectively at 11 and 21. These handle sections can be used to bring the rear section forward the index fingers at 21, while the lower front handle section at 11 can be grasped by the thumbs and rear fingers.

There is further shown in FIG. 1, at 12 and its counterpart at 13, lower bracket plate sections, which can be metal or high performance thermoplastic, for securing handle 11. Bracket plates 12 and 13 also have stud elements, which can be thermoplastic or metal, as illustrated by 14, in FIG. 2*b*, which can be welded or screwed to corner sections 16 and 17. Retaining nuts at 18, which can be thermoplastic or metal, and its counterpart at 19, not shown can be screwed onto the end of the stud elements illustrated by 14.

Upper bracket plate sections illustrated at 22 which can be metal or thermoplastic, secure upper handle section 21. Sleeve elements illustrated by 24 are integrally attached to the upper plate sections illustrated by 22. Steel spring elements 26 and 27 maintain separation between harmonicas 10 and 20 and the switching action as shown in FIGS. 2*a* and 2*b*. The respective springs can be free or optionally attached to the sleeve element, or the corner section if desired.

There is shown more particularly at FIGS. 2*a* and 2*b* end views of the dual harmonica array shown in FIG. 1, illustrating the switching action allowing the playing of the lower front harmonica and the upper rear harmonica.

There is further shown at FIGS. 2*a* and 2*b*, screw heads or rivet heads typically at 30. If screws are used, metal tap inserts can be used in the harmonica combs and the handles at 11 and 21 if desired.

Figure 4:
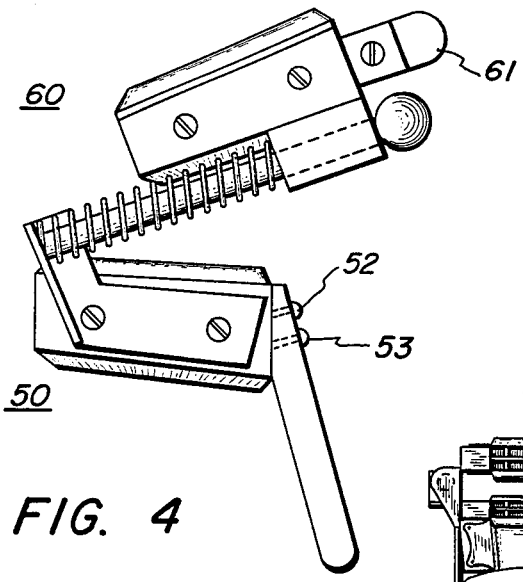
FIG. 4 is an end view of the chord array of FIG. 3 showing a detailed view of one of the end brackets and the respective bracket plates.

FIG. 3 more particularly shows a typical chord harmonica array where the harmonicas 50 and 60 can be up to about 23 inches in length. The handle at 51 is preferably about 10 to 15 inches and can be securely screwed to the base of the comb of harmonica 50 as shown in FIG. 4 at 52 and 53. Generally, the manual switching of upper rear harmonica 60 can be accomplished by using handle 61 similarly to the switching action shown in FIGS. 2*a* and 2*b*.

FIG. 4 is a side view of the dual chord array of FIG. 3.

Figure 5:
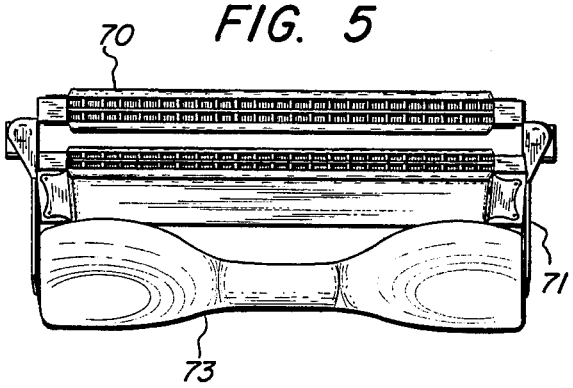
FIG. 5 is an upper angular view of a bass harmonica showing a bone shaped handle on the lower front harmonica to provide a more secure grip.

FIG. 5 is a bottom front view of a dual bass harmonica array showing bass harmonicas at 70 and 71 utilizing a bone-shaped handle at 73 to provide greater weight handling ability. The bone-shaped handle which can be wood, metal, or injection molable thermoplastic, can be attached to the lower front brackets using a screw arrangement on the terminal brackets similar to that shown for handle 11 in FIG. 1.

Figure 6:
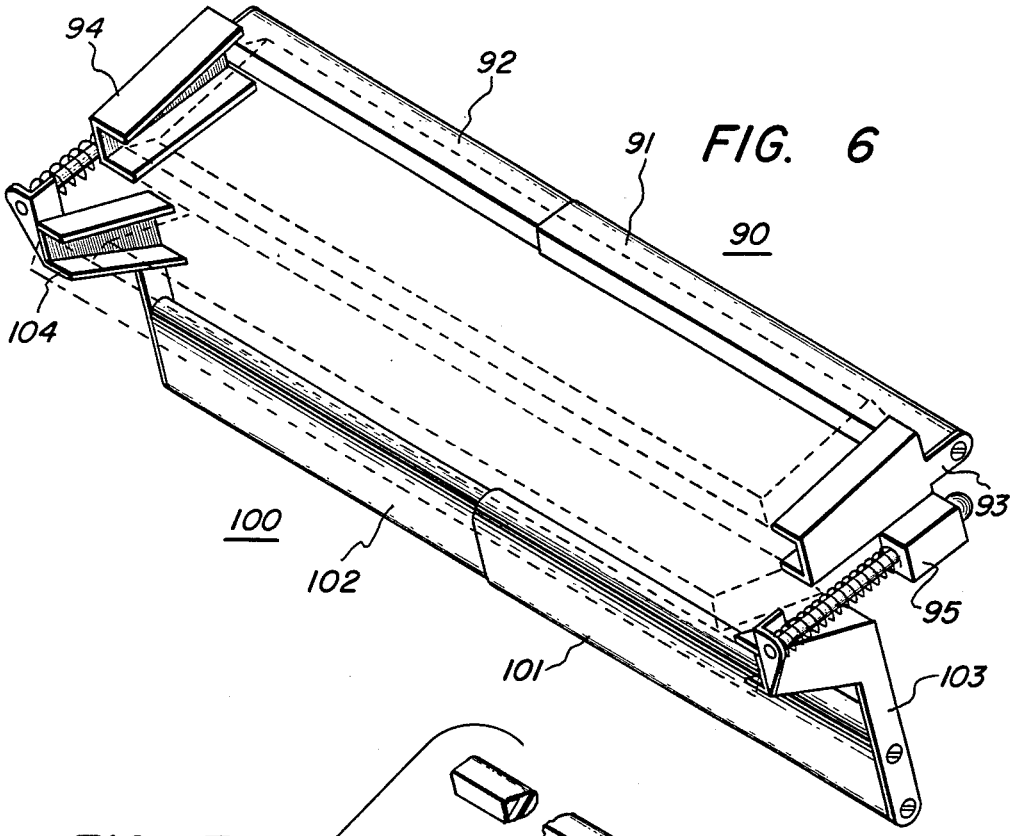
FIG. 6 is an isometric view of a dual harmonica receptacle showing phantom views of upper and lower harmonicas.

FIG. 6 is a dual harmonica receptacle showing an upper handle at 90 having a female section at 91 and a male section at 92, and a lower handle at 100 having a female section at 101 and a male section at 102.

Figure 7:
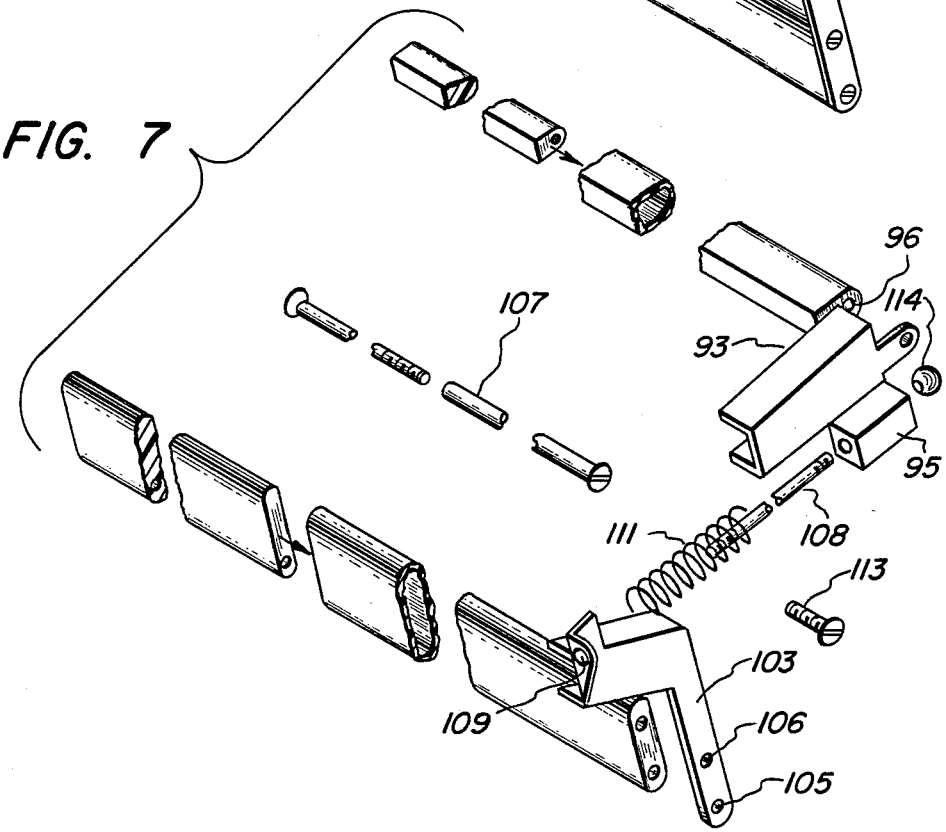
FIG. 7 are isometric views of separate elements of FIG. 6 showing upper and lower terminal bracket elements, sectional isometric views of a male and female handle parts, a stud element, a stopper element, a spring element and a variable length screw element for varying the length of the handle sections when assembled.

FIG. 7 shows more particularly, receptacle parts illustrated in FIG. 6. There is shown at 93 an upper receptacle bracket section having a sleeve element at 95 and a hole at 96 through which variable length bolt element 107 passes to connect handle 90 to brackets 93 and 94.

There is further shown in FIG. 7, lower bracket part 103 which can be connected to correspsonding bracket part 104 through handle 100 by placing a variable length bolt as shown by 107 through hole 105. Screw 113 can be used to secure handle 100 through hole 106. Stud element 108 can be screwed into holes 109 and spring 111 can then be placed on the stud. The upper receptacle section consisting of brackets 93 and 94 and handle section 90 can then be mounted on the lower receptacle section of brackets 103 and 104, and handle 100 by sliding the sleeve elements illustrated by 95 on the stud elements followed by retaining nuts illustrated by 114.

Figure 8:
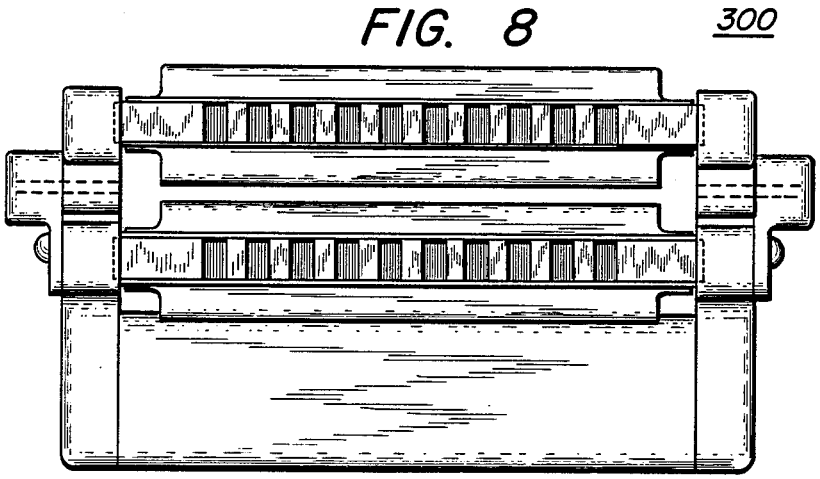
FIG. 8 is a front view of a dual harmonica array which preferably is a dual array for diatonic harmonicas having about a 4 inch to about an 8 inch comb.

There is shown in FIG. 8 a dual diatonic harmonica array having an upper movable section at 300 consisting of a receptacle harmonica section and a harmonica and a lower immovable section at 200 consisting of a receptacle section and a harmonica. The dual harmonica array can function as a chromatic harmonica without a slide. For example, the lower immovable harmonica can be in the Key of C, while the upper movable harmonica can be in the Key of D flat. The dual receptacle can be thermoplastic such as polymethylmethacrylate.

Figure 9:
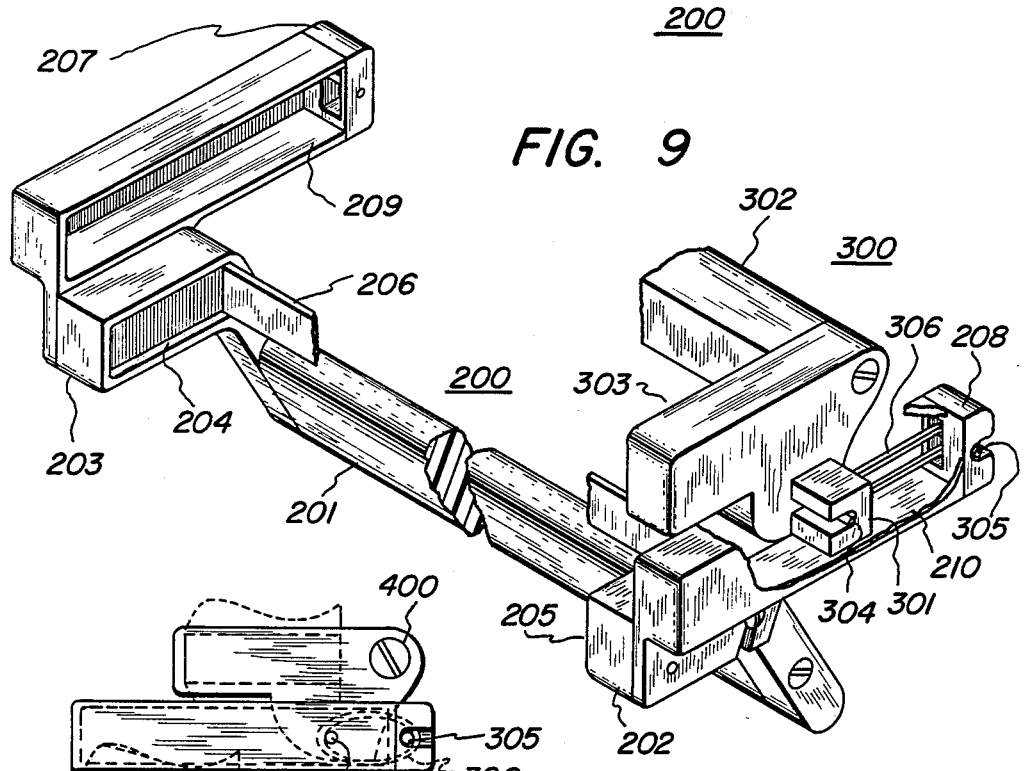
FIG. 9 is an isometric sectional view of the dual receptacle of FIG. 8 showing details of the rectangular groove and movable right element of the array, and an elastomeric or spring means.

FIG. 9 shows in detail immovable harmonica receptacle section 200, consisting of handle 201 and side handle brackets 202 and 203 having rectangular hollow grooves 204 and 205 housing the lower diatonic harmonica. Filler plate 206 can optionally be used depending upon the width of the diatonic harmonica comb. Immovable harmonica receptacle section 200 also includes superstructure 207 and 208 having rectangular grooves 209 and 210.

Movable harmonica receptacle 300 consists of handle 302 and hollow rectangular grooved end brackets illustrated by 303 which constitute the housing for the upper movable diatonic harmonica. Rider elements illustrated by 301, regulate the forward and return path through rectangular grooves 209 and 210, of the movable harmonica receptacle section.

Figure 10:
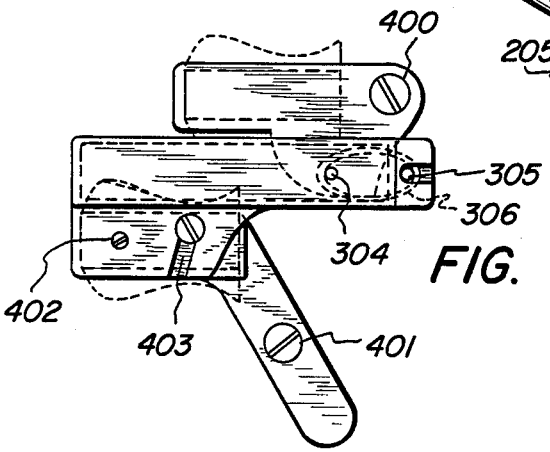
FIG. 10 is a side view of the dual harmonica array of FIG. 8 showing the diatonic harmonicas in phantom.

FIG. 10 is a side view of the dual array of FIG. 8 showing the diatonic harmonicas in phantom in a relaxed condition. There is further shown assembly screws or thumb nuts on threaded studs in slots in the plastic end pieces 400 and 401. 402 is a pivot point for right end bracket 202. Screw 403 provides lateral tightening when adjusting the angle of the rectangular grooves of receptacle sections 209–210 to change the distance and angle of the upper harmonica with respect to the lower. Threaded pins 304 and 305 provide support points for elastic rubber member 306 which allows effective spring action.

I claim:

1. A dual harmonica receptacle comprising (A) a first immovable harmonica receptacle section for holding a first harmonica in a lower forward position comprising a handle, terminal handle brackets having inwardly facing rectangularly hollow grooved forward head sections and superimposed on each of the forward head sections of the terminal handle brackets, an inwardly facing slotted super structure, (B) a second movable upper harmonica receptacle section for holding a second harmonica in an upper rear position having a handle and terminal brackets with inwardly facing rectangularly grooved sections and exterior fixed riders sized to fit within and override the inwardly facing slots of the super structures of the terminal handle brackets of (A) and (C) means for altering the relative positions of the receptacle sections of (A) and (B).

2. A dual array of diatonic harmonicas contained in the dual receptacle of claim 1.

3. A dual harmonica receptacle of claim 1, where the altering means are rubber band actuated.

4. A dual harmonica receptacle in accordance with claim 1, where the slotted super structure of (A) is adjustable.

5. A holder for dual harmonicas comprising, a first bracket means for supporting a first harmonica and placing the first harmonica in a convenient playing position, and a second bracket means for supporting a second harmonica, supporting means secured to the first bracket means to permit the second bracket means to move linearly with respect to the first bracket means permitting the second bracket means to transport the second harmonica from a position rearwardly to the convenient playing position to a position adjacent to and forwardly of the convenient playing position, and means for biasing the second bracket means toward the rearward position.

6. A holdler for dual harmonicas as in claim 5, further comprising handle means for manually sliding the second bracket means relative to the first bracket means.

7. A holder for dual harmonicas as in claim 6, wherein the handle means extends across the length of the harmonicas and is adjustable in length to accommodate harmonicas of different lengths.

8. A holder for dual harmonicas as in claim 7, wherein the handle means consists of telescopically joined elements and include means for adjusting the elements to selected positions.

9. A holder for dual harmonicas as in claim 6, wherein the handle means consists of a first handle secured to the first bracket means and a second handle secured to the second bracket means.

10. A holdler for dual harmonicas as in claim 5, wherein the biasing means consists of springs.

11. A holder for dual harmonicas as in claim 5, wherein the biasing means consists of an elastic material.

12. A holder for dual harmonicas as in claim 5, wherein the supporting means secured to the first bracket means consists of studs extending at an acute angle from the first bracket means and said biasing means consists of compression springs coiled around said studs between the first and second bracket means.

13. A holder for dual harmonicas as in claim 5, wherein the angle between said first and second bracket means is adjustable.

14. A holdler for dual harmonicas as in claim 5, wherein said bracket means are made from an injection molded thermoplastic.

15. A dual harmonica array comprising a holder for dual harmonicas as in claim 5, in combination with a first harmonica supported by said first bracket means and a second harmonica supported by said second bracket means.

16. The dual harmonica array of claim 15, wherein said harmonicas are diatonic harmonicas.

17. The dual harmonica array of claim 15, wherein said harmonicas are chord harmonicas.

18. The dual harmonica array of claim 15, wherein said harmonicas are bass harmonicas.

19. The dual harmonica array of claim 15, wherein said bracket means are made from an injection molded thermoplastic.

* * * * *